US006039212A

United States Patent [19]

Singh

[11] Patent Number: 6,039,212

[45] Date of Patent: Mar. 21, 2000

[54] AEROSOL DISPENSER

[75] Inventor: Jaswinder Singh, Woodstock, Ill.

[73] Assignee: CCL Industries Inc., Willowdale, Canada

[21] Appl. No.: 09/027,445

[22] Filed: Feb. 20, 1998

[51] Int. Cl.[7] ..... B67D 5/24

[52] U.S. Cl. ..... 222/30; 222/54; 222/646

[58] Field of Search ..... 222/646, 645, 222/649, 54, 61, 30, 63; 239/69; 137/78; 340/333

[56] References Cited

U.S. PATENT DOCUMENTS

| | | | |
|---|---|---|---|
| 3,117,586 | 1/1964 | Cleaver | 137/78 |
| 3,937,402 | 2/1976 | Query . | |
| 3,952,916 | 4/1976 | Phillips . | |
| 3,974,911 | 8/1976 | Mettler . | |
| 4,063,664 | 12/1977 | Meetze, Jr. . | |
| 4,272,019 | 6/1981 | Halaby, Jr. . | |
| 4,415,797 | 11/1983 | Choustoulakis . | |
| 4,671,435 | 6/1987 | Stout et al. | 222/646 |
| 5,025,962 | 6/1991 | Renfro . | |
| 5,038,972 | 8/1991 | Muderlak et al. | 222/25 |
| 5,097,861 | 3/1992 | Hopkins et al. | 239/69 |
| 5,111,477 | 5/1992 | Muderlak . | |
| 5,175,791 | 12/1992 | Muderlak et al. . | |
| 5,249,718 | 10/1993 | Muderlak . | |
| 5,329,949 | 7/1994 | Moncourtois et al. . | |
| 5,366,553 | 11/1994 | Lair et al. . | |
| 5,449,117 | 9/1995 | Muderlak et al. . | |
| 5,531,344 | 7/1996 | Winner | 222/649 |
| 5,574,423 | 11/1996 | Vosika et al. | 340/333 |
| 5,591,409 | 1/1997 | Watkins . | |
| 5,622,162 | 4/1997 | Johannson et al. . | |
| 5,673,825 | 10/1997 | Chen | 222/646 |

FOREIGN PATENT DOCUMENTS

| | | |
|---|---|---|
| WO94/03764 | 2/1994 | WIPO . |
| WO 96/30726 | 10/1996 | WIPO . |
| WO96/30726 | 10/1996 | WIPO . |

*Primary Examiner*—Andres Kashnikow
*Assistant Examiner*—Dinh Q. Nguyen
*Attorney, Agent, or Firm*—Baker & Daniels

[57] ABSTRACT

An aerosol dispenser includes a housing adapted to accommodate an aerosol container. A spray mechanism communicates with the aerosol container and is actuable to dispense an aerosol spray of material from the aerosol container. A controller actuates the spray mechanism to effect dispensing of the aerosol material. A remote unit is provided to establish a wireless communication link with the controller.

30 Claims, 14 Drawing Sheets

07: 28 AM

> GET AEROSOL DISPENSER STATUS <
UPLOAD SELECTED PROGRAM TO AEROSOL DISPENSER
TEST AEROSOL DISPENSE

FIG. 13

07: 29 AM

SELECT PROGRAM TO UPLOAD TO AEROSOL DISPENSER
OR TO EDIT

EDIT DATA IN SELECTED PROGRAM
> SET REAL TIME CLOCK <

FIG. 14

07: 30 AM

OPERATION SETTINGS

VOLUME

E F

BATTERY

E F

FIG. 15

AEROSOL DISPENSER

FIELD OF THE INVENTION

The present invention relates generally to dispensers and in particular to an aerosol dispenser to dispense an aerosol spray of material from a replaceable aerosol container at selected intervals.

BACKGROUND OF THE INVENTION

Aerosol dispensers to dispense an aerosol spray of material from a replaceable aerosol container are well known in the art. Dispensers of this nature have been designed to dispense insecticides to control insects and pests as well as fragrances to provide consistent pleasant aromas. For example, U.S. Pat. No. 4,671,435 to Stout et al discloses a programmable wide area insecticide dispensing system and method. The system includes a plurality of pressurized insecticide tanks connected to spray heads positioned at various locations within a facility such as a warehouse, barn etc. A programmable controller is hard-wired to each of the spray heads and effects the dispensing of insecticide from the tanks at predetermined times and in predetermined amounts by selectively actuating the spray heads.

U.S. Pat. No. 5,038,972 to Muderlak et al discloses a metered aerosol fragrance dispensing apparatus for periodically operating an aerosol container to dispense discrete quantities of aerosol material. The apparatus includes a powered mechanism to actuate the aerosol container and effect dispensing of aerosol material. An energizing means activates a warning mechanism when the actuation count of the aerosol container reaches a predetermined number thereby to indicate the probable total evacuation of the aerosol container. The apparatus also includes circuitry which can be conditioned to control the operation of the apparatus in different modes by manually actuating a switch. The different modes include a continuous intermittent operation, a controlled daytime operation and a controlled night operation.

Although the above-identified references disclose devices to dispense aerosol material, these prior art aerosol dispensers are impractical in many environments. Accordingly, there is a need for an improved aerosol dispenser.

It is therefore an object of the present invention to provide a novel aerosol dispenser.

SUMMARY OF THE INVENTION

According to one aspect of the present invention there is provided an aerosol dispenser comprising:

a housing adapted to accommodate an aerosol container;

a spray mechanism communicating with said aerosol container and being actuable to dispense an aerosol spray of material from said aerosol container; and a controller to actuate said spray mechanism, said controller including a wireless communication receiver to receive operation information from a remote source transmitted over a wireless communication link.

In one embodiment, the operation information includes operation settings determining selected intervals at which the spray mechanism is actuated by the controller. The operation settings include an interval setting and a duration setting. The controller actuates the spray mechanism at the selected intervals as determined by the interval setting and for a duration determined by the duration setting. It is also preferred that the operation settings include start and stop time settings. The controller actuates the spray mechanism at the selected intervals when the current time is between the start and stop time settings.

Preferably, the controller includes a central processing unit having a clock and memory storing the operation settings together with an operation routine executed by the central processing unit. The central processing unit accesses the operation settings during execution of the operation routine and is remotely programmable. It is also preferred that the memory contains a status routine executed by the central processing unit. The central processing unit checks its current operation settings programming, calculates an amount of aerosol material remaining in the aerosol container and checks the status of the aerosol dispenser power supply upon execution of the status routine.

Preferably, the aerosol dispenser further includes at least one ambient condition sensor in communication with the controller. The controller inhibits actuation of the spray mechanism when the ambient condition sensed by the at least one ambient condition sensor is beyond a threshold level. In a preferred embodiment, the at least one ambient condition sensor is in the form of a temperature sensor and/or wind speed indicator.

In another embodiment, the operation information received from the remote source is in the form of a spray command. The controller actuates the spray mechanism in response to the spray command for a duration equal to the duration of the spray command.

According to another aspect of the present invention there is provided an aerosol dispensing system comprising:

an aerosol dispenser including a housing adapted to accommodate an aerosol container; a spray mechanism communicating with said aerosol container, said spray mechanism being actuable to dispense an aerosol spray of material from said aerosol container; and a controller to actuate said spray mechanism at selected intervals; and a remote unit to communicate with said controller via a wireless communication link.

In one embodiment, it is preferred that the controller is remotely programmable by the remote unit over the wireless communication link. In this case, the remote unit stores at least one set of default operation settings. The remote unit is actuable to transmit the at least one set of default operation settings over the wireless communication link to the controller for storage therein. The controller accesses the operation settings and actuates the spray mechanism in accordance therewith. Preferably, the remote unit stores a plurality of different sets of default operation settings.

In still yet another aspect of the present invention there is provided an aerosol dispensing system comprising:

an aerosol dispenser including a housing having a nozzle and adapted to accommodate an aerosol container; a controller executing a programmed instruction set therein and outputting valve mechanism control signals at selected intervals in accordance with said instruction set; a selectively-operated valve mechanism coupled to said nozzle and releasably receiving an aerosol container, said valve mechanism being actuable in response to said control signals to dispense aerosol material in said aerosol container via said nozzle; and a remote unit to communicate with said controller via a wireless communication link, said remote unit being operable to transmit programmed instruction sets to said aerosol dispenser for storage therein.

In still yet another aspect of the present invention there is provided an aerosol dispenser comprising:

a housing adapted to accommodate an aerosol container;

a controller within said housing and generating spray mechanism control signals at selected intervals;

a spray mechanism communicating with said aerosol container and being actuable in response to said control signals to dispense aerosol material in said aerosol container; and a plurality of ambient condition sensors mounted on said housing for sensing different ambient conditions, said controller communicating with said sensors and inhibiting generation of said control signals when at least one of said ambient conditions is beyond a threshold level.

The aerosol dispenser in accordance with the present invention provides advantages in that its operation can be controlled remotely by way of operation information transmitted over a wireless communication link. Therefore, in environments where aerosol dispensers are spread over a wide area and/or are positioned in hard to reach places, such as for example orchards or within office buildings, the aerosol dispensers do not need to be physically accessed when it is desired to control their operation, check their status or test their operation. In addition, in the case of aerosol dispensers used in outdoor environments, since the aerosol dispensers monitor ambient conditions such as temperature and/or wind speed, aerosol material is not needlessly dispensed if environmental conditions do not warrant the use of the aerosol material.

BRIEF DESCRIPTION OF THE DRAWINGS

Embodiments of the present invention will now be described more fully with reference to the accompanying drawings in which:

FIG. 13 is an illustration of a first set of menu options displayed by the remote hand-held unit of FIG. 11;

FIG. 14 is an illustration of a second set of menu options displayed by the remote hand-held unit of FIG. 11;

FIG. 15 is an illustration of status information displayed by the remote hand-held unit of FIG. 11;

DETAILED DESCRIPTION OF THE PREFERRED EMBODIMENTS

Figure 1:
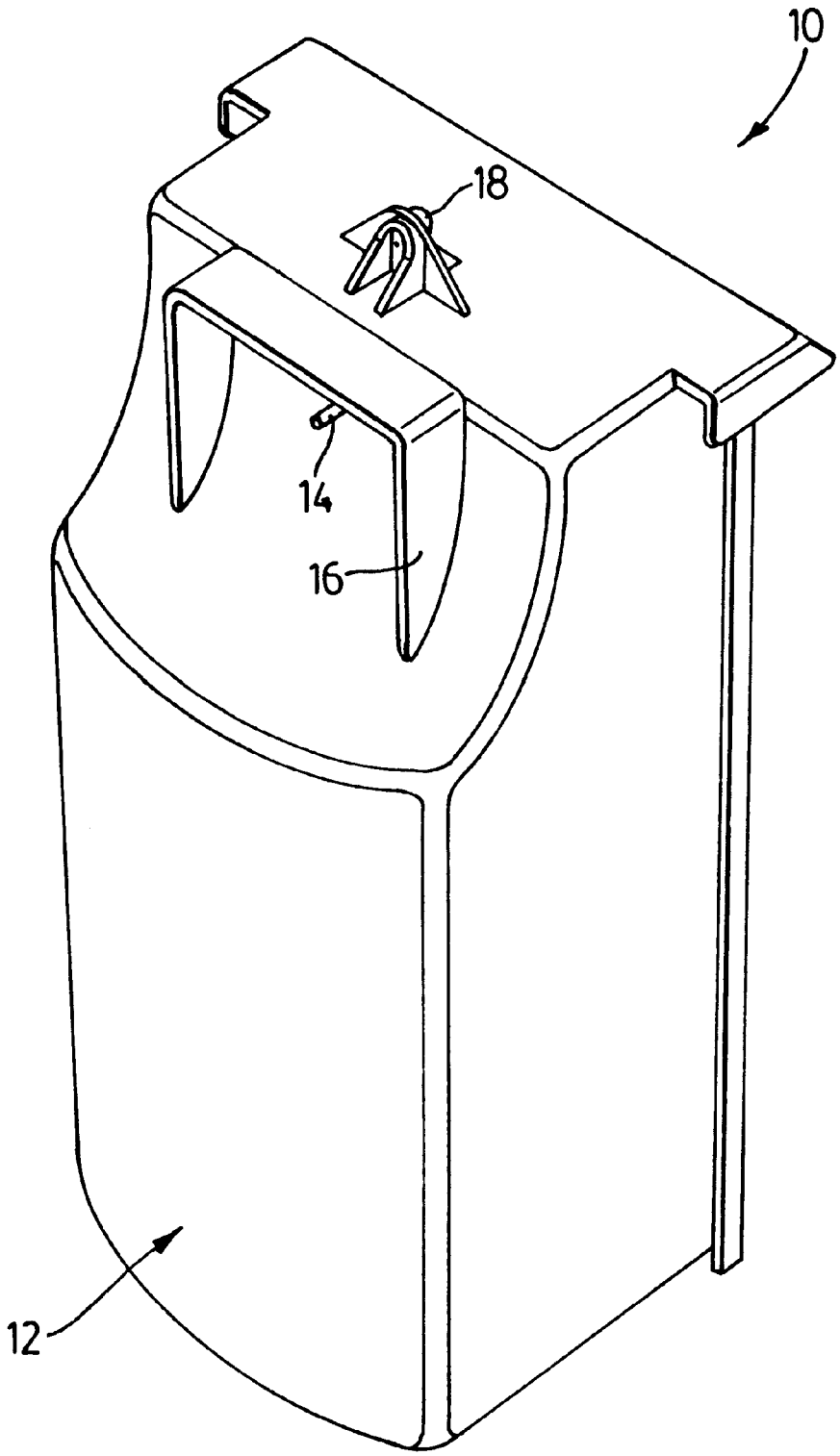
FIG. 1 is a perspective view taken from above and from the side of an aerosol dispenser in accordance with the present invention.
Figure 2:
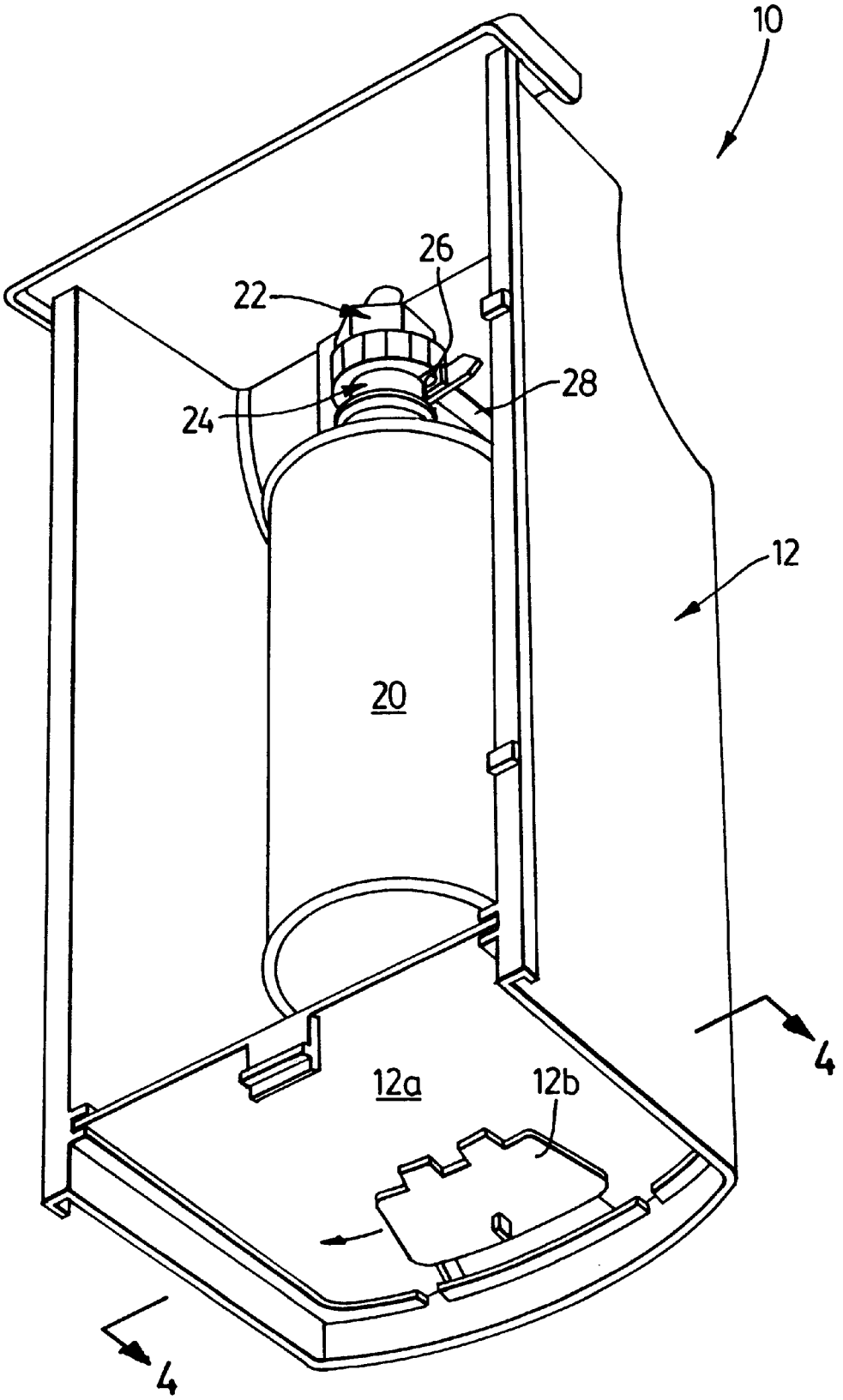
FIG. 2 is a perspective view taken from below and from the side of the aerosol dispenser of FIG. 1.

Referring now to FIGS. 1 to 7, an aerosol dispenser in accordance with the present invention is shown and is generally indicated to by reference numeral 10. As can be seen the aerosol dispenser 10 includes an enclosure or housing 12 having a dispensing nozzle 14 through which an aerosol spray of material is dispensed on an intermittent basis to an ambient atmosphere. An inverted generally U-shaped baffle 16 on the housing 12 surrounds the nozzle 14. A bell-shaped projection 18 is provided on the top of the housing 12 to allow the aerosol dispenser to be suspended from a tree or other convenient structure.

Within the housing 12 is an aerosol container 20 (shown in FIG. 2) containing aerosol material to be dispensed to the environment outside of the housing 12 via the nozzle 14. The housing 12 is designed to accommodate a variety of different size aerosol containers 20. In the present invention, the aerosol container contains a chemical to control insects and other pests or a chemical to control odors.

The aerosol container 20 is mounted in a releasable relation to a solenoid-activated valve mechanism 22 by way of an adaptor assembly 24. The solenoid-activated valve mechanism 22 is fixedly mounted to the housing 12 by releasable fasteners 26 engaging internally threaded posts 28 and is operatively connected to the nozzle 14 so that an aerosol spray of material may be dispensed from the aerosol container 20 through the nozzle 14. The solenoid-activated valve mechanism 22 may have any convenient structure which permits selective opening and closing to dispense an aerosol spray of material from the aerosol container 20 through the nozzle 14. The valve mechanism structure may be of the type described in U.S. Pat. No. 3,666,144, assigned to the assignee of the present invention, but any other convenient valve mechanism may be adopted. The adaptor assembly 24 is preferably of the type described in U.S. Pat. No. 5,489,047, assigned to the assignee of the present invention, to facilitate replacement of aerosol containers 20.

A power supply 30 is fixedly mounted in the housing 12 below the solenoid-activated valve mechanism 22 by releasable fasteners (not shown) engaging internally threaded posts (not shown). The power supply 30 is of the type to accommodate a plurality of batteries. A circuit board mounted controller 32 is also fixedly secured to the housing 12 by releasable fasteners 34 engaging internally threaded posts 36. The controller 32 is positioned below the power supply 30. A dividing wall 38 extends from the housing 12 between the power supply 30 and the controller 32. Conductors (not shown) extend around the dividing wall 38 to interconnect the power supply 30 and the controller 32. Conductors 40 also extend around the dividing wall 38 to interconnect the controller 32 and the solenoid-activated valve mechanism 22 allowing the controller 32 to control the frequency of opening of the valve mechanism 22 to dispense an aerosol spray of material through the nozzle 14 and the length of time the valve mechanism 22 is open for such dispensing. A slidable, channel-shaped cover 42 overlies the controller 32.

Figure 3:
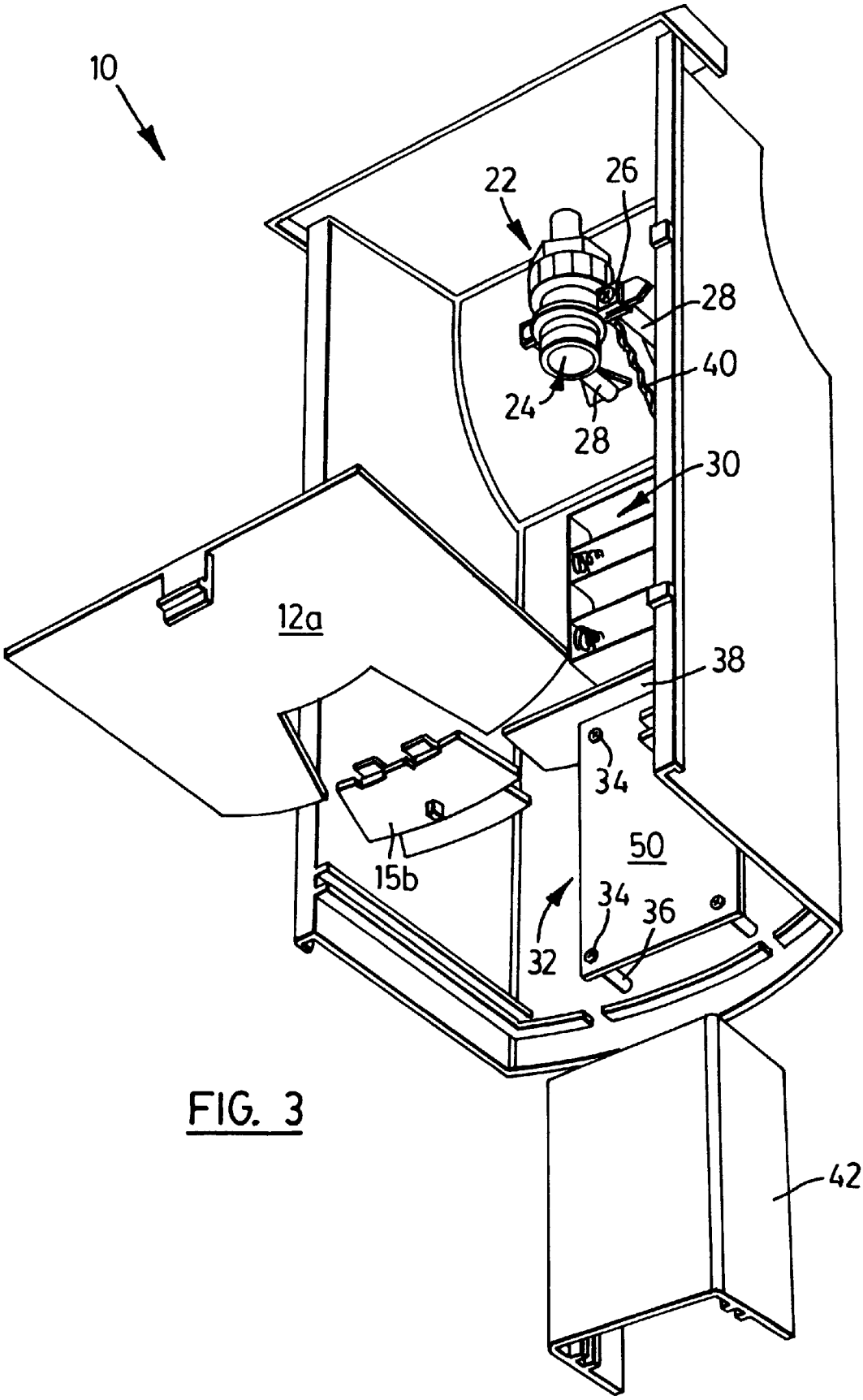
FIG. 3 is a perspective view, partially exploded, taken from below and from the side of the aerosol dispenser of FIG. 1 with the aerosol container can removed.
Figure 4:
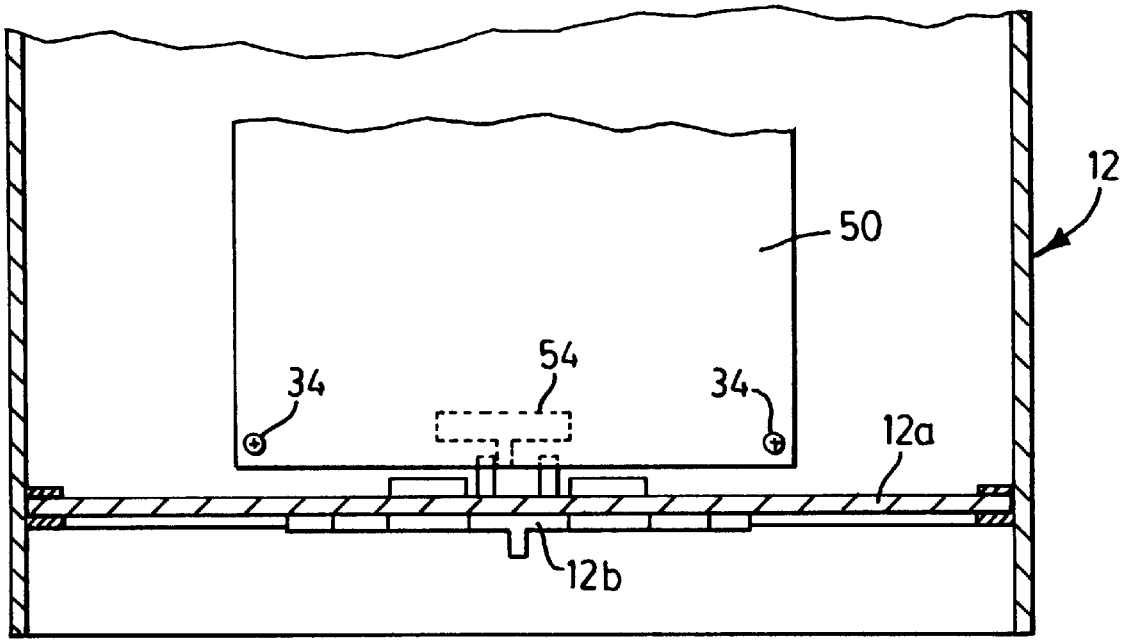
FIG. 4 is a scrap sectional view of FIG. 3 taken along line 4—4.
Figure 5:
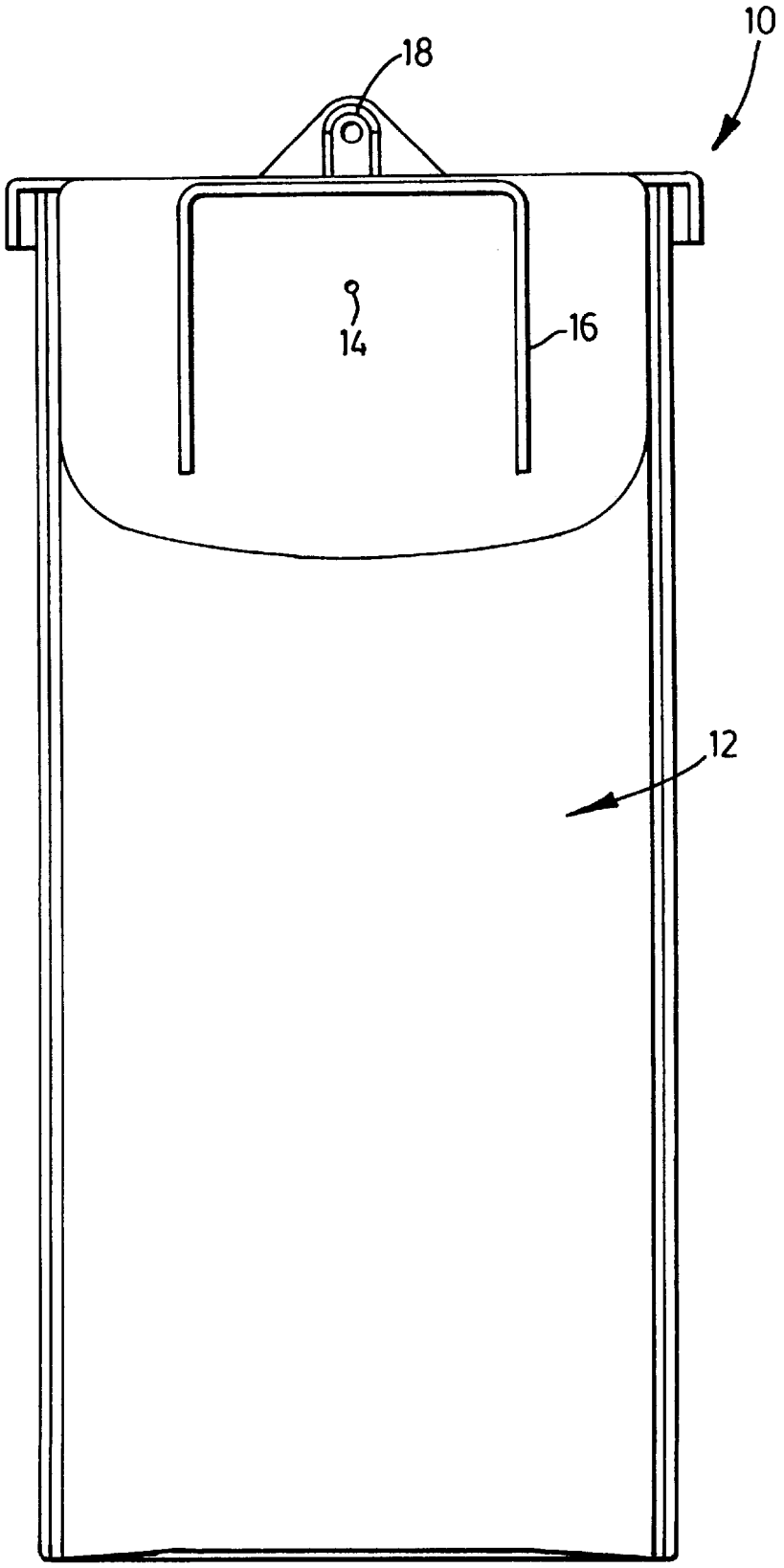
FIG. 5 is a front elevational view of the aerosol dispenser of FIG. 1.
Figure 6:
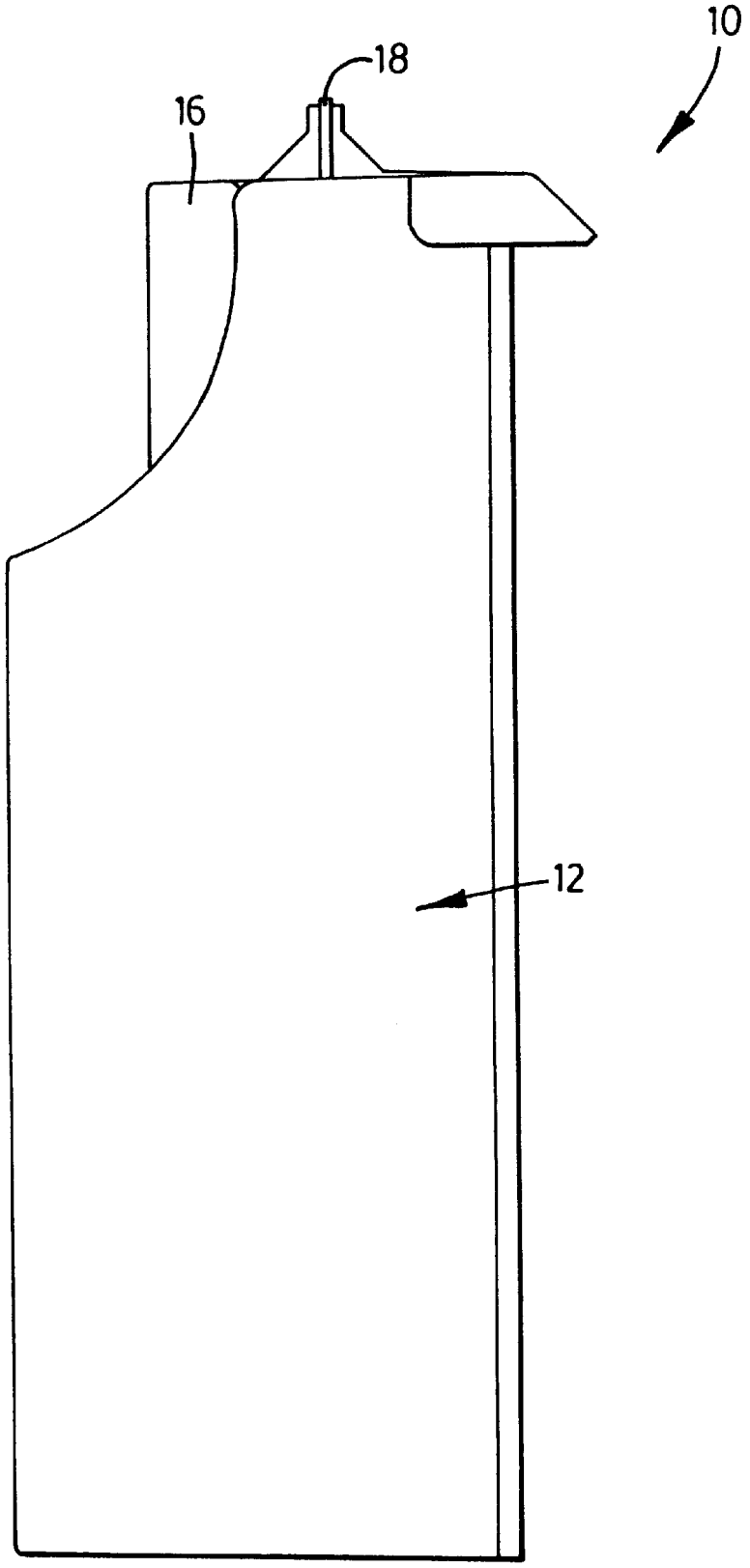
FIG. 6 is a side elevational view of the aerosol dispenser of FIG. 1.
Figure 7:
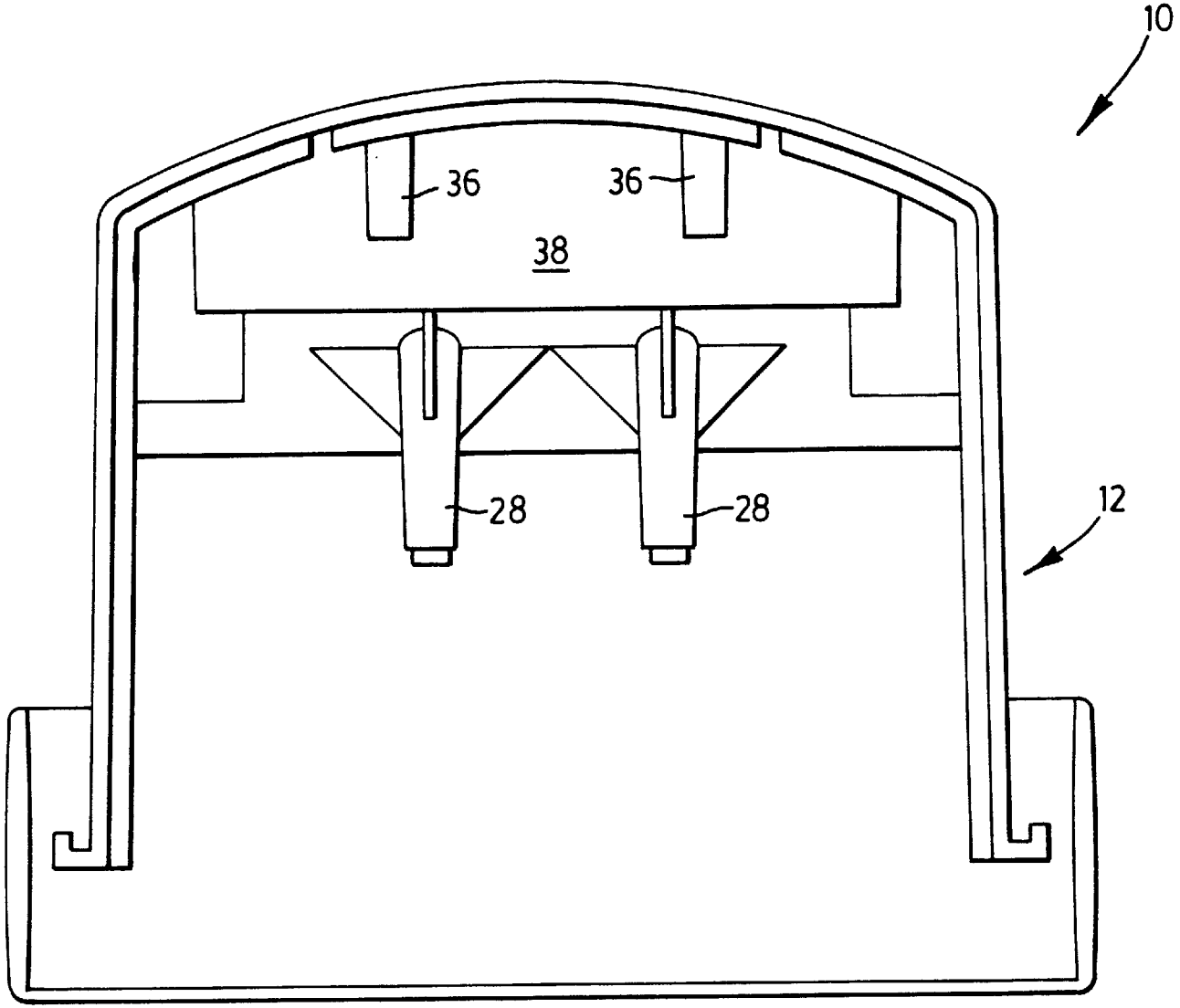
FIG. 7 is a bottom plan view of the aerosol dispenser of FIG. 1.
Figure 8:
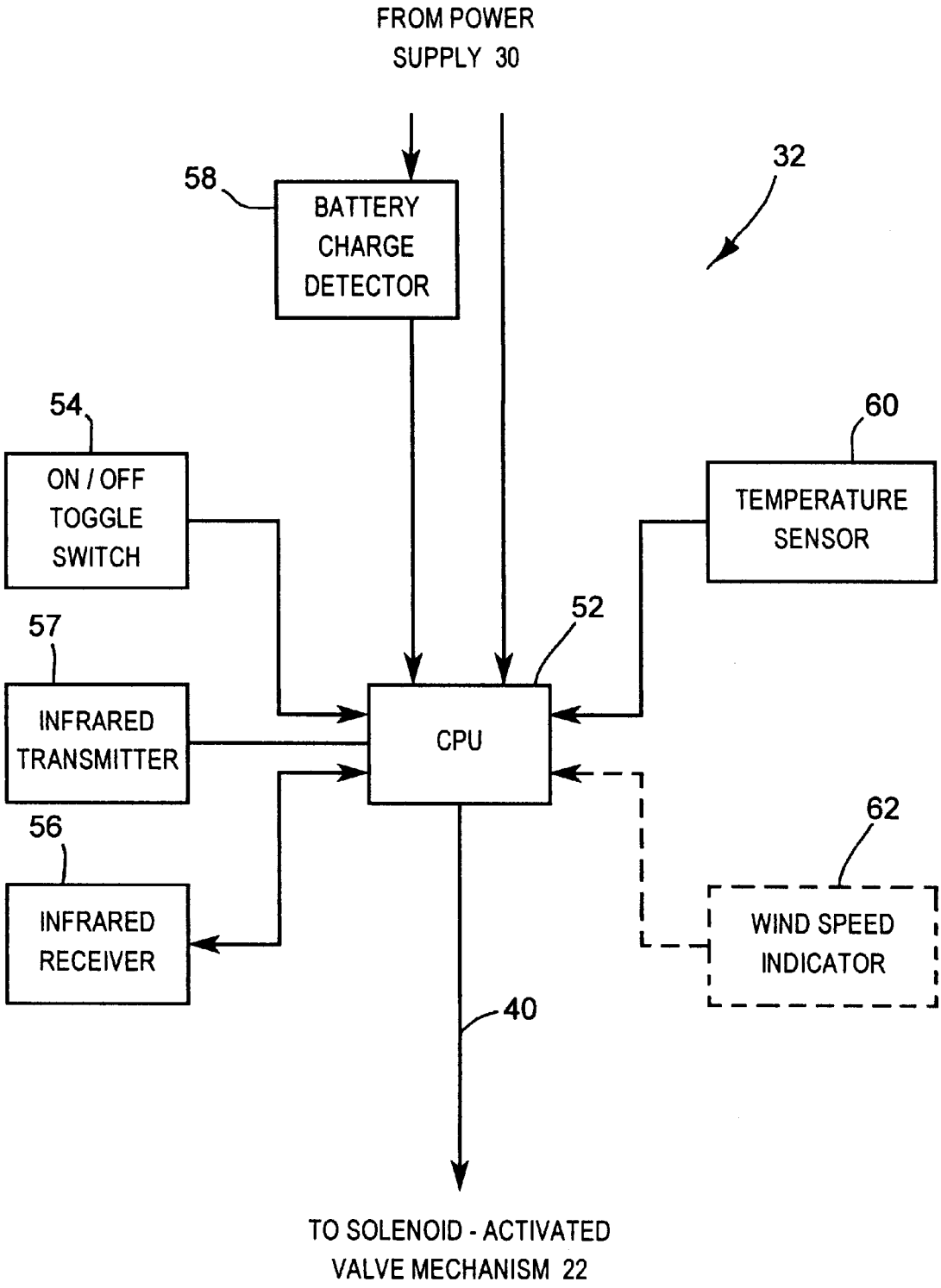
FIG. 8 is a schematic block diagram of a controller forming part of the aerosol dispenser of FIG. 1.

Referring now to FIGS. 3, 4 and 8, the controller 32 is better illustrated. As can be seen, the components of the controller 32 are mounted on a circuit board 50 to which the conductors are connected. The controller 32 includes a central processing unit (CPU) 52 having a real time clock and resident memory (not shown). The CPU 52 is connected to an on/off toggle switch 54, an infrared receiver 56, an infrared transmitter 57, a battery charge detector 58, a temperature sensor 60 and optionally, a wind speed detector 62 shown in dotted lines that is mounted on the housing 12. The on/off toggle switch 54, infrared receiver 56 and infrared transmitter 57 are mounted on circuit board 50 so that they are positioned near the base 12*a* of the housing 12.

Figure 9:
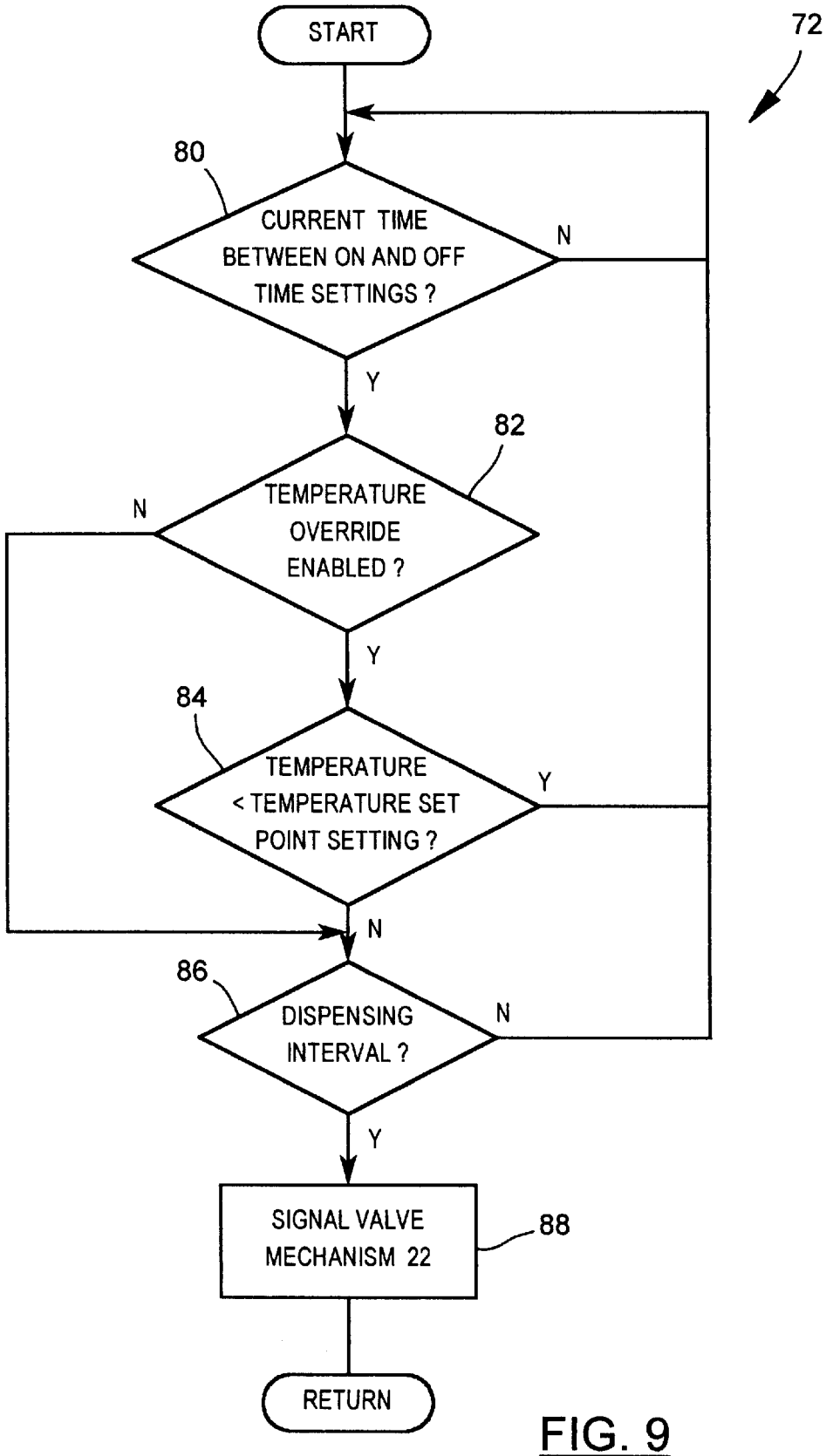
FIG. 9 is a flowchart of an aerosol dispenser operation routine executed by the controller of FIG. 8.
Figure 10:
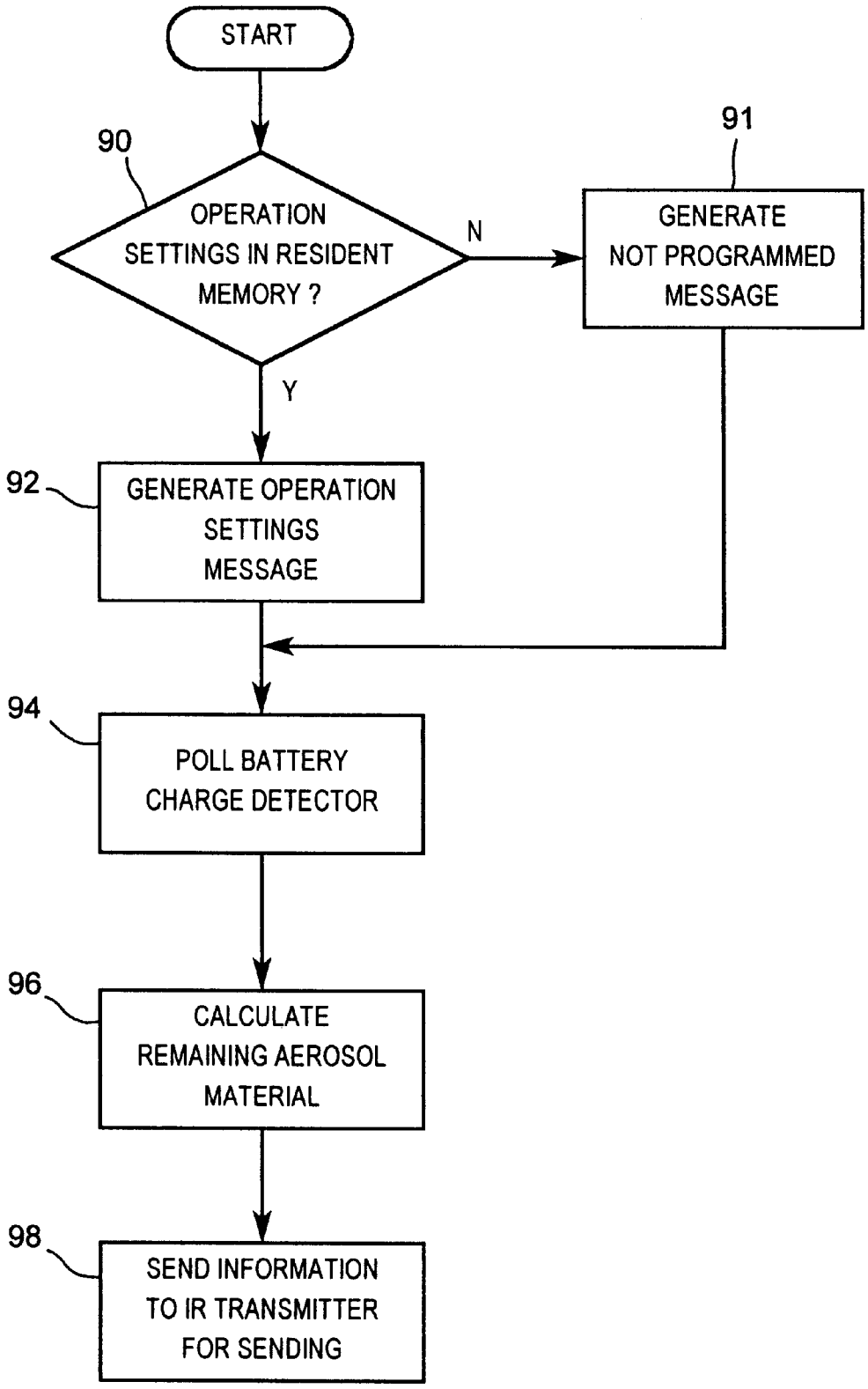
FIG. 10 is a flowchart of an aerosol dispenser status routine executed by the controller of FIG. 8.

The resident memory stores programmed aerosol dispenser operation settings received from a remote hand-held unit 100 (see FIG. 11) and a main program executed by the CPU 52. The main program includes an aerosol dispenser status routine 70 (see FIG. 10) and an aerosol dispenser operation routine 72 (see FIG. 9). The operation settings include a "Start Time" setting, a "Stop Time" setting, a "Spray Interval" setting, a "Dosage" setting, a "Temperature Control" setting, a "Stop Temperature" setting and a "Can Weight" setting. The Start and Stop Time settings determine the hours of a day during which the aerosol dispenser 10 operates to dispense aerosol material. The Spray Interval setting determines the frequency or intervals at which the valve mechanism 22 is actuated by the controller 32. The Dosage setting determines the length of time the valve mechanism 22 is kept open each time it is actuated by the controller 32. The Temperature Control setting determines whether the controller 32 is responsive to the temperature sensor 60 and the Stop Temperature setting establishes the threshold temperature below which the controller 32 inhibits actuation of the valve mechanism 22. The Can Weight setting allows the controller 32 to calculate the amount of aerosol material remaining in the aerosol container.

The base 12*a* of the housing 12 includes a sliding switch 12*b* formed of polycarbonate material coupled to the on/off toggle switch 54 to allow the aerosol dispenser 10 to be turned on and off without having to access the interior of the housing. However, the base 12*a* and rear wall (not shown) of the housing 12 are removable to facilitate access to the interior of the housing if necessary. The sliding switch 12*b* acts as a window for infrared light to facilitate the establishment of a wireless communication link between the controller 32 and the remote hand-held unit 100 to allow the status of the aerosol dispenser 10 to be checked and the operation settings of the aerosol dispenser to be changed remotely.

In operation, when the switch 12*b* is moved to the on position to move the on/off toggle switch 54 to the on position, the controller 32 is powered by the power supply 30. Once powered, the CPU 52 performs an internal diagnostic routine and then executes the aerosol dispenser operation routine 72. During execution of this routine, the CPU 52 accesses the operation settings and monitors the real time clock to determine if the current time is between the Start and Stop Time settings (block 80). If the current time is not between the Start and Stop Time settings, the CPU 52 simply continues through a loop comparing the current time with the Start and Stop Time settings. If the current time is between the Start and Stop Time settings, the CPU 52 determines whether the Temperature Control setting is enabled (block 82). If the Temperature Control setting is enabled, the CPU 52 polls the temperature sensor 60 to determine the ambient temperature and compares temperature sensed by temperature sensor 60 with the Stop Temperature setting (block 84). If the sensed temperature is below the Stop Temperature setting, the CPU 52 returns to block 80.

If the sensed temperature is equal to or above the Stop Temperature setting or if the Temperature Control setting is disabled, the CPU 52 checks the current time to determine if the current time is a multiple of the Spray Interval setting (block 86). If not, the CPU 52 returns to block 80. However, if the current time is a multiple of the Spray Interval setting, the CPU 52 signals the solenoid-activated valve mechanism 22 for the duration determined by the Dosage setting causing the valve mechanism 22 to open for that duration (block 88). With the valve mechanism 22 open, an aerosol spray of material is dispensed from the aerosol container 20 through the nozzle 14. Following this, the CPU 52 loops back to block 80 and the above steps are performed again. As will be appreciated, the Spray Interval setting determines the amount of aerosol material dispensed during actuation of the valve mechanism 22. In the present embodiment, the amount of aerosol dispensed per valve mechanism actuation can be set in the range of from about 30 mg to 150 mg. This provides for greater flexibility as compared to metered aerosol dispensers which always dispense the same amount of aerosol material each time the aerosol dispenser is actuated.

When the CPU 52 executes the aerosol dispenser status routine 70, the CPU 52 examines its resident memory to determine whether it has been programmed with operation settings (block 90). If the resident memory does not contain programmed operation settings, the CPU 52 generates a "not programmed" message (block 91). If the resident memory contains programmed operation settings, the CPU 52 generates an "operation setting" message including its current programmed operation settings (block 92). The CPU 52 then polls the battery charge detector 58 to determine the current charge of the batteries in the power supply 30 (block 94). The CPU 52 also calculates the amount of aerosol material remaining in the aerosol container 20 (block 96) by subtracting the amount of aerosol material dispensed from the aerosol container (which is the product of the Dosage setting in mgs and the number of times the valve mechanism 22 has been opened) by the amount of aerosol material originally in the aerosol container as determined by the Can Weight setting. Once, the above steps have been performed, the CPU 52 sends the generated message and the battery level and aerosol material level to the infrared transmitter 57 which in turn transmits the information over a wireless infrared communication link (block 98).

Figure 11:
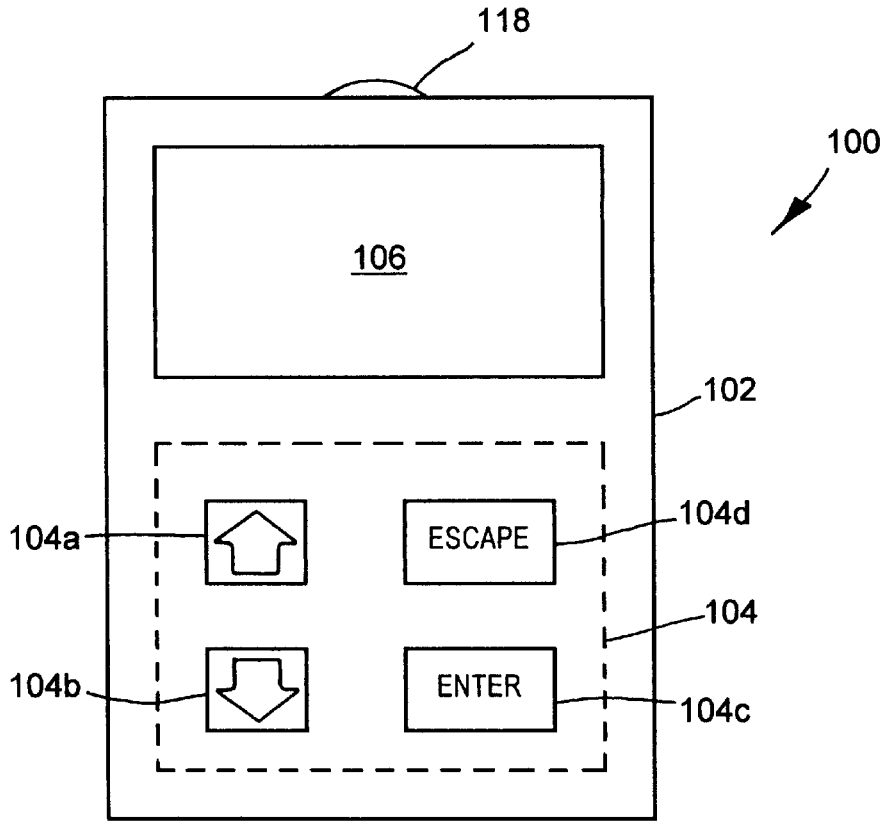
FIG. 11 is a top plan view of a remote hand-held unit which communicates with the aerosol dispenser of FIG. 1 over a wireless communication link.
Figure 12:
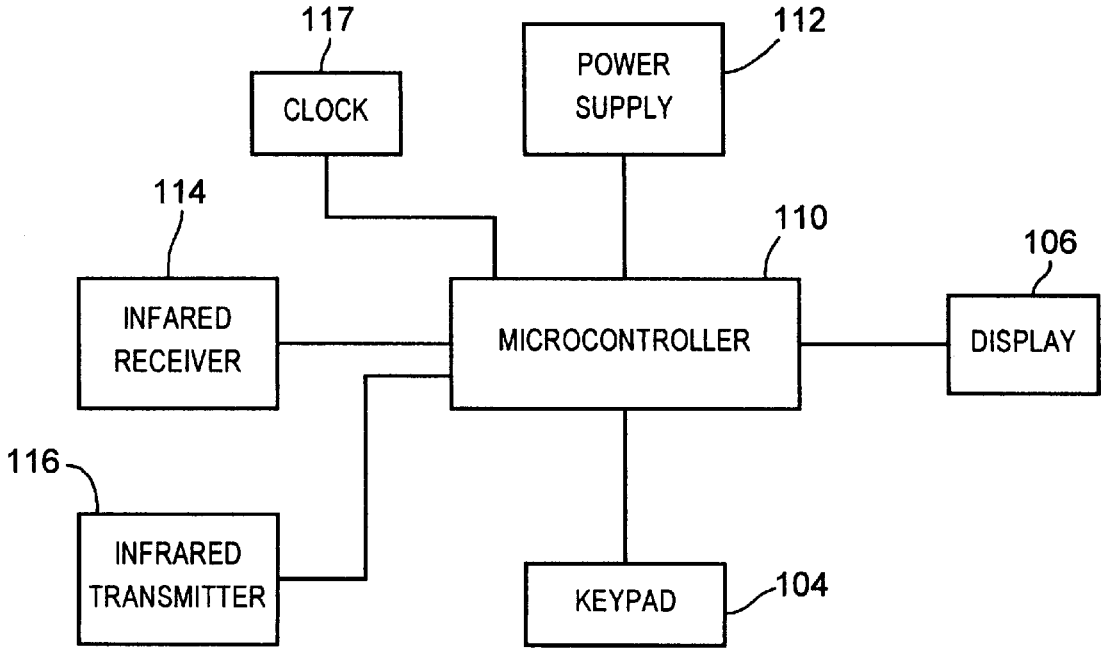
FIG. 12 is a schematic block diagram of the remote hand-held unit of FIG. 11.

Referring now to FIGS. 11 and 12, the remote hand-held unit 100 to communicate with the aerosol dispenser over a wireless infrared communication link is illustrated. As can be seen, the remote hand-held unit 100 includes a casing 102 having a keypad 104 and a display 106 on its upper surface. In this embodiment, the keypad 104 includes up and down arrow keys 104*a* and 104*b*, an enter key 104*c* and an escape key 104*d*. A microcontroller 110, battery power supply 112, infrared receiver 114, infrared transmitter 116 and real time clock 117 are provided within the casing 102. An infrared window 118 is provided at one end of the casing 102. The microcontroller 110 controls the operation of the remote hand-held unit 100 and executes software to allow the status of the aerosol dispenser 10 to be checked, its operation settings changed and its clock setting adjusted remotely.

The microcontroller 110 includes resident memory storing two different preprogrammed aerosol dispenser default operation settings as well as non-volatile memory capable of storing 99 different aerosol dispenser default operation settings at memory locations labeled 1 to 99. One of the preprogrammed default operation settings includes the following defaults:

Start Time=6 pm.

Stop Time=6 am.

Spray Interval=15 minutes

Dosage=25 ms (approximately 60 mgs)

Temperature Control enabled

Stop Temperature=10° C.

Can Weight 288 gr.

The other preprogrammed default operation settings include the following defaults:

Start Time=6 pm.

Stop Time=6 am.

Spray Interval=15 minutes

Dosage=60 ms (approximately 30 mgs)

Temperature Control enabled

Stop Temperature Set Point=10° C.

Can Weight 576 gr.

When the remote hand-held unit 100 is powered up, the microcontroller 110 executes an initialization routine. During the initialization routine, the microcontroller 110 retrieves the default aerosol dispenser operation settings from the resident memory and writes the first preprogrammed default operation settings to memory locations 1 to 49 and writes the second preprogrammed default operation settings to memory locations 50 to 99. Following this, the microcontroller 110 presents on the display 106, the time of the real time clock 117 as well as a first set of menu options (see FIG. 13) as follows:

Get Aerosol Dispenser Status

Upload Selected Program To Aerosol Dispenser

Test Aerosol Dispenser

A second set of menu options (see FIG. 14) can be presented on the display 106 instead of the first set of menu options by pressing the escape key 104*d* on the keypad 104. The second set of menu options is as follows:

Select Program To Upload To Aerosol Dispenser Or To Edit

Edit Data In Selected Program

Set Real Time Clock

Pressing the escape key 104*d* allows an operator to toggle between the first and second sets of menu options. The operator can select an option from the displayed set of menu options by moving the cursor on the display 106 via the up and down keys 104*a* and 104*b* respectively and pressing the enter key 104*c* when the cursor is positioned at the desired menu option. With the remote hand-held unit 100 pointed at the aerosol dispenser 10, depending on the option selected, one of a number of events can occur as will now be described.

If the operator selects the "Get Aerosol Dispenser Status" option, the remote hand-held unit 100 transmits a status request to the aerosol dispenser 10 over a wireless infrared communication link via the infrared transmitter 116. When the controller 32 in the aerosol dispenser receives the status request via the infrared receiver 56, the CPU 52 executes the aerosol dispenser status routine 70 described previously. Once the aerosol dispenser status routine 70 has been executed, the CPU 52 conveys either the "not programmed" or "operation settings" message together with the battery charge and aerosol material level information to the infrared transmitter 57 for transmission to the remote hand-held unit 100 over the wireless communication link. When the remote hand-held unit 100 receives the information via the infrared receiver 114, the microcontroller 110 presents the received information on the display 106 (see FIG. 15).

When the operator selects the "Upload Selected Program To Aerosol Dispenser" option (assuming the desired operation settings have already been selected), the microcontroller 110 conveys the selected operation settings to the infrared transmitter 116 which in turn transmits the selected operation settings over the wireless communication link to the aerosol dispenser 10. When the controller 32 receives the operation settings via the infrared receiver 56, the CPU 52 overwrites its current preprogrammed operation settings. The controller 32 then sends a message to the remote hand-held unit 100 over the wireless communication link providing its new programmed operation settings. The remote hand-held unit 100 in turn presents the operation settings on the display 106 to confirm that the operation settings have been changed.

When the operator selects the "Test Aerosol Dispenser" option, the remote hand-held unit 100 transmits a spray command to the aerosol dispenser 10. When the controller 32 receives the spray command, the CPU 52 either sends the "not programmed" message or the "operation setting" message to the infrared transmitter 57 for transmission to the remote hand-held unit 100. The controller 32 then actuates the valve mechanism 22 causing the valve mechanism to dispense one "puff" of aerosol material from the aerosol container 20 after a delay equal to approximately 6 seconds has occurred to allow the operator to confirm visually the proper operation of the valve mechanism.

When the operator selects the "Select Program" option, the operator is prompted to select the memory location number corresponding to the desired operation settings to be selected using the up and down arrow keys 104*a* and 104*b*.

When the operator wishes to change the operation settings in any one of the 99 memory locations, the operator must select the operation settings to be changed by choosing the Select Program option in the manner described above and then select the "Edit Program" option. The microcontroller 110 in turn presents the selected operation settings on the display 106 allowing the operator to edit the operation settings on a line by line basis.

When the operator selects the "Set Real Time Clock" option, the microcontroller 110 positions the cursor over the displayed time allowing the operator to adjust the time using the up and down arrow keys 104*a* and 104*b*.

During communications between the remote hand-held unit 100 and the aerosol dispenser 10, if a communication link cannot be established, a "Communication Problem" message is presented on the display 106. Also, to preserve battery life in the aerosol dispenser, the controller 32 can be programmed not to respond to communications received from the remote hand-held unit 100 during a specified time period.

As will be appreciated, if the aerosol dispenser 10 includes a wind speed indicator 62, the operation settings in the memory will also include a Wind Speed Override setting and a Wind Speed Set Point setting. In this case, during execution of the aerosol dispenser operation routine 72, before the CPU 52 signals the solenoid-activated valve mechanism 22 to open to dispense an aerosol spray of material, the CPU 52 checks to determine if the Wind Speed Override is enabled and if so, whether the wind speed sensed by the wind speed indicator 62 is below the Wind Speed Set Point setting before activating the valve mechanism 22. In addition, the aerosol dispenser 10 can also include an indicator such as a light or beeper which is responsive to the controller 32 when the battery level or calculated aerosol material level in the aerosol container is low to provide a physical indication of these conditions.

The present invention provides advantages in that the status of the aerosol dispenser can be determined and the operating settings of the aerosol container can be changed remotely via a wireless communication link obviating the need to access physically each aerosol dispenser individually. This is particularly useful in environments where the aerosol dispensers are spread out over a wide area and/or are in hard to reach places.

Although the CPU is described as being initially unprogrammed, the CPU can of course initially be preprogrammed with one or more sets of default operation settings.

Figure 16:
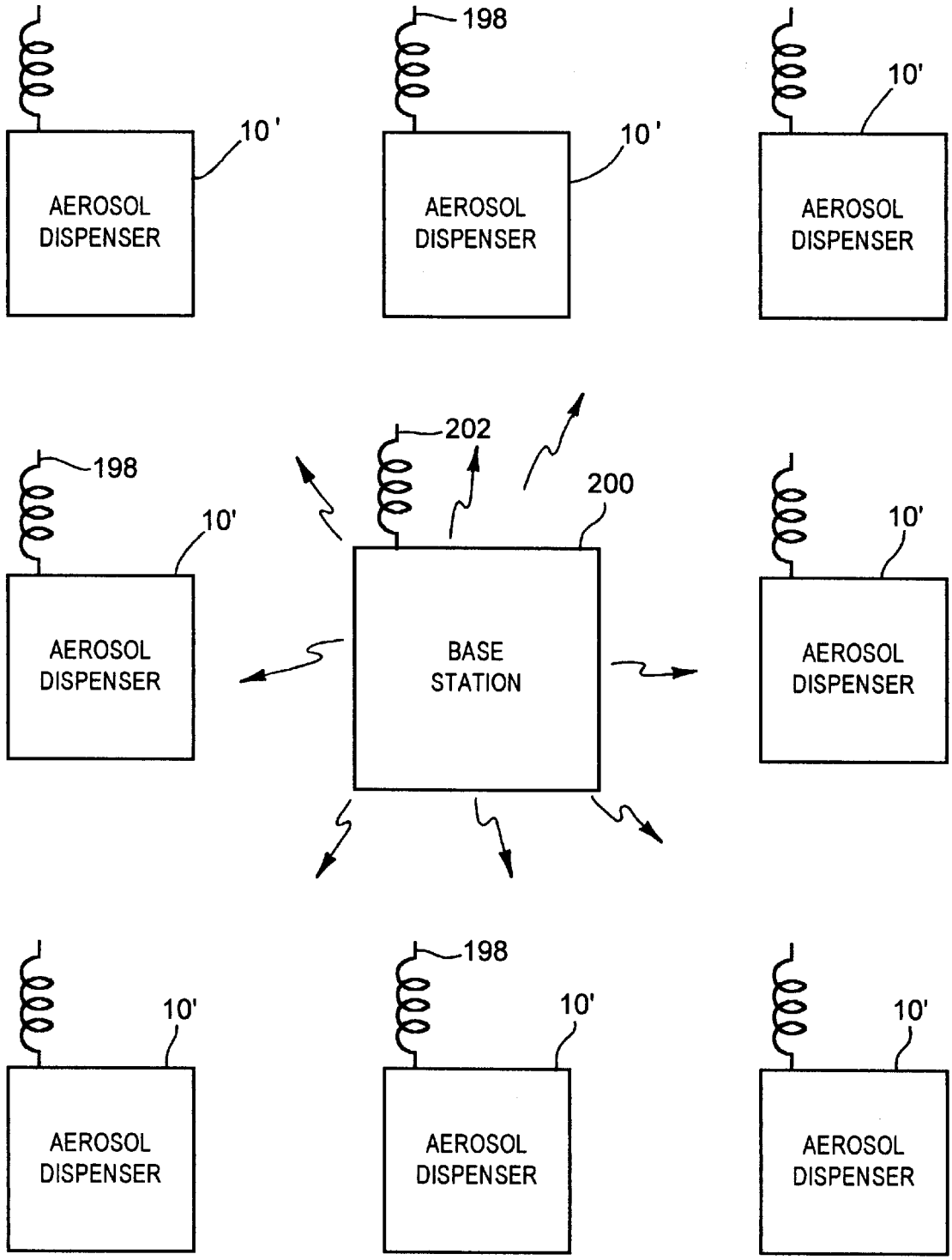
FIG. 16 is an illustration of an aerosol dispensing system including a plurality of aerosol dispensers in accordance with an alternative embodiment of the present invention.

Although the aerosol dispenser 10 is described as communicating with a remote hand-held unit via a wireless infrared communication link, it should be appreciated that alternative wireless communication links such as radio frequency (RF) communication links can be used. For example, referring now to FIG. 16, a plurality of aerosol dispensers 10' according to the present invention are shown. In this case, each of the aerosol dispensers includes an RF receiver and an RF transmitter instead of an infrared receiver and infrared transmitter. The RF receiver and RF transmitter communicate with an antenna 198 mounted on top of the housing. The aerosol dispensers 10' communicate with a central base station 200 via a wireless RF communication link.

In this embodiment, the base station 200 includes a CPU having resident memory storing the aerosol dispenser operation settings and executes the aerosol dispenser operation routine 72 to determine whether the current time is within the Start and Stop Time settings; whether the Temperature Control setting is enabled, and if so whether the ambient temperature is below the Stop Temperature setting; and whether the current time is a multiple of the Spray Interval setting. If the conditions are such that aerosol material is to be sprayed, the base station 200 broadcasts a spray command for a duration determined by the Dosage setting over the wireless RF communication link via its antenna 202. The base station allows the operation settings to be changed if desired and allows the Temperature Control to be disabled.

The RF receiver in each aerosol dispenser 10' upon receiving the spray command, conveys the command to the CPU 52 which in turn actuates the valve mechanism 22 causing the valve mechanism 22 to open allowing aerosol to be dispensed through the nozzle 14. The CPU keeps the valve mechanism 22 open for as long as the spray command is received.

Figure 17:
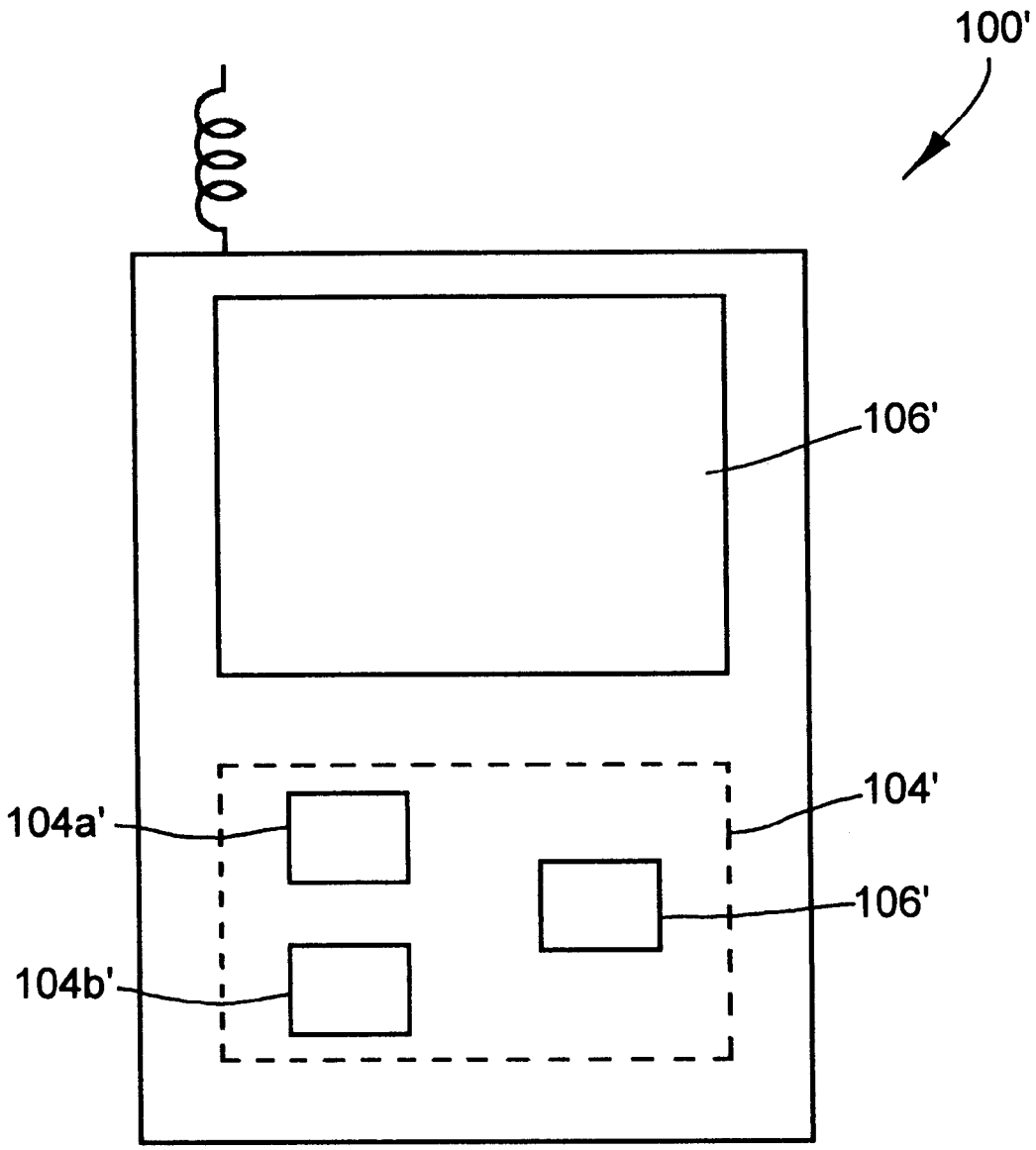
FIG. 17 is a top plan view of a remote hand-held unit which communicates with the aerosol dispensers of FIG. 16 over a wireless communication link.

A remote hand-held unit 100' (see FIG. 17) including an RF receiver and an RF transmitter also communicates with the aerosol dispensers 10' but only allows the aerosol dispensers to be tested and their status checked. In this case, the keypad 104' includes two test keys 104*a'* and 104*b'* and an aerosol dispenser status key 104*c'*. With the remote hand-held unit 100' pointed at an aerosol dispenser 10', when test key 104*a'* is pressed, the remote hand-held unit 100' transmits a command to the aerosol dispenser via the RF transmitter. The controller 32 in the aerosol dispenser 10' upon receiving the command sounds a beeper allowing the operator to locate physically the aerosol dispenser being tested. When the test key 104*b'* is pressed, the remote hand-held unit 100' transmits another command to the aerosol dispenser via the RF transmitter. The controller 32 in the aerosol dispenser 10' upon receiving the command actuates the valve mechanism 22 for a short duration so that aerosol material is dispensed through the nozzle briefly. This allows the operator to test the spray operation of the aerosol dispenser remotely.

When the aerosol dispenser status key 104*c'* is pressed, the remote hand-held unit transmits the status request to the aerosol dispenser via the RF transmitter. When the status request is received, the CPU executes the aerosol dispenser status routine 70 as described previously. The status information is then transmitted to the remote hand-held unit 100' and is displayed on the display 106'.

If desired, the aerosol dispensers and base station can include different selectable RF settings to allow the frequency at which information is transmitted to be set to one of a number of preset frequencies. This is useful when different operators are using aerosol dispensers in accordance with the present inventions in proximal areas to avoid situations where aerosol dispensers owned by one operator respond to spray commands generated by a base station owned by another operator.

Although the aerosol dispenser has been described as including a nozzle communicating with a solenoid activated valve mechanism to dispense aerosol material from an aerosol container, other sprayhead configurations can of course be used such as for example mechanical dispensers which physically contact the aerosol container at selected intervals causing the aerosol container to dispense aerosol material.

Although particular embodiments of the present invention have been described, those of skill in the art will appreciate that variations and modifications may be made without departing from the spirit and scope thereof as defined by the appended claims.

I claim:

1. An aerosol dispenser comprising:

a housing adapted to accommodate an aerosol container;

a spray mechanism communicating with said aerosol container and being actuable to dispense an aerosol spray of material from said aerosol container; and a controller to actuate said spray mechanism, said controller including a wireless communication receiver to receive operation information from a remote source transmitted over a wireless communication link and a central processing unit in communication with said wireless communication receiver and said spray mechanism, said central processing unit including a clock and memory storing operation settings and an operation routine executed by said central processing unit, said operation settings determining selected intervals at which said spray mechanism is actuated and the duration of actuation, said operating settings being accessed by said central processing unit during execution of said operation routine and being remotely programmable by said remote source via said wireless communication link.

2. An aerosol dispenser as defined in claim 1 wherein said operation settings include an interval setting and a duration setting, said controller actuating said spray mechanism at said selected intervals as determined by said interval setting and for the duration determined by said duration setting.

3. An aerosol dispenser as defined in claim 2 wherein said operation settings further include start and stop time settings, said controller actuating said spray mechanism at said selected intervals when the current time of said clock is between said start and stop time settings.

4. An aerosol dispenser as defined in claim 3, wherein said memory further stores a status routine executed by said central processing unit, said central processing unit calculating an amount of aerosol material remaining in said aerosol container upon execution of said status routine.

5. An aerosol dispenser as defined in claim 4 wherein said central processing unit executes said status routine in response to a status command received from said remote source via said wireless communication link.

6. An aerosol dispenser as defined in claim 5 wherein said aerosol dispenser further includes a battery power supply and wherein said controller further includes a battery charge detector for detecting the charge of batteries in said power supply, wherein during execution of said status routine, said central processing unit polls said battery charge detector to determine the charge of said battery power supply.

7. An aerosol dispenser as defined in claim 6 wherein said controller further includes a wireless communication transmitter to transmit the calculated amount of remaining aerosol material and the charge of said battery power supply to said remote source via said wireless communication link in response to said status command.

8. An aerosol dispenser as defined in claim 3 further including at least one ambient condition sensor in communication with said controller, said controller inhibiting actuation of said spray mechanism when the ambient condition sensed by said at least one ambient condition sensor is beyond a threshold level.

9. An aerosol dispenser as defined in claim 8, wherein said threshold level is determined by an operation setting in said memory.

10. An aerosol dispenser as defined in claim 9 wherein said at least one ambient condition sensor is in the form of a temperature sensor, said controller inhibiting operation of said spray mechanism when the temperature sensed by said temperature sensor is below said threshold level.

11. An aerosol dispenser as defined in claim 9 wherein said at least one ambient condition sensor is in the form of a wind speed indicator, said controller inhibiting operation of said spray mechanism when the wind speed sensed by said wind speed indicator exceeds said threshold level.

12. An aerosol dispenser as defined in claim 1 wherein said controller is responsive to spray commands received from said remote source via said wireless communication receiver, said central processing unit actuating said spray mechanism in response to a spray command irrespective of said operation settings.

13. An aerosol dispenser as defined in claim 12 wherein said controller actuates said spray mechanism for a duration equal to the duration of said spray command.

14. An aerosol dispensing system comprising in combination:

an aerosol dispenser including a housing adapted to accommodate an aerosol container; a spray mechanism communicating with said aerosol container, said spray mechanism being actuable to dispense an aerosol spray of material from said aerosol container; and a controller to actuate said spray mechanism; and a remote unit to communicate with said controller via a wireless communication link, wherein said controller is remotely programmable by said remote unit over said wireless communication link to establish selected intervals at which said spray mechanism is actuated by said controller and the duration said spray mechanism is actuated at each interval.

15. An aerosol dispensing system as defined in claim 14 wherein said controller includes a central processing unit including a clock and memory storing operation settings and an operation routine executed by said central processing unit, said operation settings being accessed by said central processing unit during execution of said operation routine and being remotely programmable via said remote unit.

16. An aerosol dispensing system as defined in claim 15 wherein said operation settings include an interval setting and a duration setting, said controller actuating said spray mechanism at said selected intervals as determined by said interval setting and for durations determined by said duration setting.

17. An aerosol dispensing system as defined in claim 16 wherein said operation settings further include start and stop time settings, said controller actuating said spray mechanism at said selected intervals when the current time of said clock is between said start and stop time settings.

18. An aerosol dispensing system as defined in claim 17 wherein said remote unit stores at least one set of default operation settings, said remote unit being actuable to transmit said at least one set of default operation settings over said wireless communication link to said controller for storage in said memory.

19. An aerosol dispensing system as defined in claim 18 wherein said remote unit stores a plurality of different sets of default operation settings.

20. An aerosol dispensing system as defined in claim 19 wherein said memory further stores a status routine executed by said central processing unit, said central processing unit calculating an amount of aerosol material remaining in said aerosol container upon execution of said status routine, said remote unit being actuable to signal said controller via said wireless communication to cause said central processing unit to execute said status routine, said controller transmitting the calculated amount of remaining aerosol material to said remote unit over said wireless communication link.

21. An aerosol dispensing system as defined in claim 19 wherein said aerosol dispenser further includes a battery power supply and wherein said controller further includes a battery charge detector for detecting the charge of batteries in said power supply, wherein during execution of said status routine, said central processing unit polls said battery charge detector to determine the charge of said battery power supply, said controller transmitting the detected battery charge to said remote unit over said wireless communication link.

22. An aerosol dispensing system as defined in claim 17 further including at least one ambient condition sensor in communication with said controller, said controller inhibiting actuation of said spray mechanism when the ambient condition sensed by said at least one ambient condition sensor is beyond a threshold level determined by an operation setting in said memory.

23. An aerosol dispensing system as defined in claim 22 wherein said at least one ambient condition sensor is in the form of a temperature sensor, said controller inhibiting operation of said spray mechanism when the temperature sensed by said temperature sensor is below said threshold level.

24. An aerosol dispensing system as defined in claim 14 wherein said remote unit is actuable to transmit a spray command to said aerosol dispenser, said controller actuating said spray mechanism in response to said spray command irrespective of said operation settings.

25. An aerosol dispensing system as defined in claim 24 wherein said controller actuates said spray mechanism for a duration equal to the duration of said spray command.

26. An aerosol dispensing system comprising:

an aerosol dispenser including a housing having a nozzle and being adapted to accommodate an aerosol container; a controller executing a programmed instruction set therein and outputting valve mechanism control signals at selected intervals and for selected durations in accordance with said instruction set; a selectively-operated valve mechanism coupled to said nozzle and releasably receiving an aerosol container, said valve mechanism being actuable in response to said control signals to dispense aerosol material in said aerosol container via said nozzle at said selected intervals and for said selected durations; and a remote unit to communicate with said controller via a wireless communication link, said remote unit being operable to transmit programmed instruction sets to said aerosol dispenser for storage therein.

27. An aerosol dispensing system as defined in claim 26 wherein said instruction set includes an interval setting and a duration setting, said controller actuating said valve mechanism at said selected intervals as determined by said interval setting and for the durations determined by said duration setting.

28. An aerosol dispensing system as defined in claim 27 wherein said instruction set further includes start and stop time settings, said controller actuating said valve mechanism at said selected intervals when the current time is between said start and stop time settings.

29. An aerosol dispensing system as defined in claim 28 wherein said remote unit stores at least one instruction set including a plurality of default settings, said remote unit being actuable to transmit said default settings over said wireless communication link to said controller for storage therein.

30. An aerosol dispensing system as defined in claim 29 wherein said remote unit stores a plurality of instruction sets, each instruction set including different default settings.

* * * * *